US009615714B2

(12) United States Patent
Jang et al.

(10) Patent No.: US 9,615,714 B2
(45) Date of Patent: Apr. 11, 2017

(54) AUTONOMOUS CLEANING DEVICE

(71) Applicant: Samsung Electronics Co., Ltd., Suwon-si (KR)

(72) Inventors: Hwi Chan Jang, Yongin-si (KR); Won Min Lee, Busan (KR); Sang Hwa Choi, Suwon-si (KR); Du Hwan Hyun, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 618 days.

(21) Appl. No.: 14/033,971

(22) Filed: Sep. 23, 2013

(65) Prior Publication Data

US 2014/0131123 A1 May 15, 2014

(30) Foreign Application Priority Data

Nov. 9, 2012 (KR) ..... 10-2012-0126899
Dec. 3, 2012 (KR) ..... 10-2012-0139022

(51) Int. Cl.
*A47L 11/40* (2006.01)

(52) U.S. Cl.
CPC ..... *A47L 11/4061* (2013.01); *A47L 11/4066* (2013.01); *A47L 11/4072* (2013.01); *A47L 2201/00* (2013.01); *A47L 2201/04* (2013.01)

(58) Field of Classification Search
CPC .. A47L 2201/00; A47L 9/2805; A47L 9/2842; A47L 9/2857; A47L 11/4061; A47L 11/4066; A47L 9/2889
See application file for complete search history.

(56) References Cited

U.S. PATENT DOCUMENTS 4,968,878 A * 11/1990 Pong ..... A47L 11/4011 15/319
5,341,540 A * 8/1994 Soupert ..... A47L 11/4011 15/319
5,440,216 A * 8/1995 Kim ..... A47L 5/28 15/319
8,239,992 B2 * 8/2012 Schnittman ..... A47L 11/34 15/319
2004/0031121 A1 * 2/2004 Martin ..... A47L 9/02 15/246.2

(Continued)

FOREIGN PATENT DOCUMENTS

KR 10-2012-0042391 5/2012
KR 10-2012-0044162 5/2012
KR 10-2012-0044436 5/2012

OTHER PUBLICATIONS

European Decision on Grant dated May 8, 2015 in corresponding European Patent Application No. 13186484.5.

*Primary Examiner* — Robert Scruggs
(74) *Attorney, Agent, or Firm* — Staas & Halsey LLP

(57) ABSTRACT

Provided is an autonomous cleaning device that is capable of embodying various travelling motions, improving an obstacle avoidance capability, and stably travelling, the autonomous cleaning device including: a case in which an accommodation part and a hole are formed; and a wheel assembly accommodated in the accommodation part, wherein the wheel assembly includes: one wheel, of which part is exposed to an outside through the hole; a first motor that drives and travels the wheel; and a second motor that rotates the wheel so as to change a travelling direction.

25 Claims, 23 Drawing Sheets

(56) References Cited

U.S. PATENT DOCUMENTS

| | | | | |
|---|---|---|---|---|
| 2005/0055792 | A1* | 3/2005 | Kisela | A47L 5/36 15/319 |
| 2005/0229340 | A1* | 10/2005 | Sawalski | A47L 11/24 15/50.3 |
| 2008/0052867 | A1* | 3/2008 | Park | A47L 9/009 15/319 |

* cited by examiner

AUTONOMOUS CLEANING DEVICE

CROSS-REFERENCE TO RELATED APPLICATIONS

This application claims the benefit of Korean Patent Application No. 10-P2012-126899, filed on Nov. 9, 2012 and Korean Patent Application No. P2012-139022, filed on Dec. 3, 2012, in the Korean Intellectual Property Office the disclosures of which are incorporated herein by references.

BACKGROUND

1. Field

Embodiments of the present disclosure relate to an autonomous cleaning device that is capable of driving in an omni-direction and embodying various travelling motions.

2. Description of the Related Art

An autonomous cleaning device is a device that travels about an area to be cleaned to perform a cleaning task by inhaling foreign substances including dust from a floor without user manipulation. The autonomous cleaning device determines a distance from the current position to an obstacle, such as a furniture, an office supply, or a wall within a zone to be cleaned using a distance sensor and selectively drives a left-wheel motor and a right-wheel motor of the autonomous cleaning device, thereby cleaning the zone to be cleaned by changing direction.

In the autonomous cleaning device according to the related art, one or two wheels that receive power are provided, and one or more nonpowered wheels are provided so that the autonomous cleaning device can be stably supported. The autonomous cleaning device having such a wheel structure moves backward or moves forward after rotating when it collides with an obstacle during travel so as to be prevented from being caught by the obstacle.

SUMMARY

Therefore, it is an aspect of the present disclosure to provide an autonomous cleaning device in which wheels capable of travelling in an omni-direction are used so that the autonomous cleaning device can be reliably prevented from being caught by an obstacle regardless of the shape of the autonomous cleaning device and can embody various travelling motions.

Additional aspects will be set forth in part in the description which follows and, in part, will be obvious from the description, or may be learned by practice of the invention.

In accordance with one aspect, there is provided an autonomous cleaning device including: a case in which an accommodation part and a hole are formed; and a wheel assembly accommodated in the accommodation part, wherein the wheel assembly includes: one wheel, of which part is exposed to an outside through the hole; a first motor that drives and travels the wheel; and a second motor that rotates the wheel so as to change a travelling direction.

An elastic member may be interposed between a bottom surface of the case and a top surface of a pad part.

A bumper may be further provided at outer sides of the case, and the bumper may cover all outer sides of the case.

A sensor coupling part may be provided at the case, and a sensor that is capable of detecting an external obstacle may be mounted on the sensor coupling part.

A plurality of sensor coupling parts and a plurality of sensors may be provided so as to detect all obstacles positioned in an omni-direction.

A plurality of inwardly-protruding arms may be provided at the bumper, and if the bumper is pressurized by an external shock, the plurality of arms may pressurize the sensor.

A protruding coupling rib may be provided on a bottom of the case, a coupling hole may be formed in each of the arms, and the coupling rib may be inserted into the coupling hole so that a bumper body is movably mounted on the case.

Holes may be formed in the bottom of the case and the pad part and communicate with each other, and the wheel may be exposed to an outside through the holes.

The wheel assembly may be accommodated in a wheel case, and a hole through which the wheel passes and is exposed to an outside may be formed in a bottom of the wheel case.

The hole formed in the bottom of the wheel case, the hole formed in the bottom of the case, and the hole formed in the pad part may communicate with one another.

Legs may be formed on a bottom surface of the wheel case, and grooves corresponding to the legs may be formed in a top surface of the case so that the legs are inserted into the grooves and the wheel case is fixed to the top surface of the case.

The wheel may be exposed to an outside through a center of the pad part.

In accordance with an aspect, there is provided an autonomous cleaning device including: a base having a hole formed in a center of the base; a pad part, which is mounted on a bottom surface of the base and in which a hole corresponding to the hole is formed; a wheel that is accommodated in the base and is exposed to an outside through the hole formed in the base and the hole formed in the pad part; a first motor that travels the wheel; and a second motor that changes a travelling direction of the wheel.

The first motor and the second motor may be mounted on a wheel cover, and the wheel cover may be mounted on the base.

The first motor may be connected to the wheel, and the second motor may rotate the first motor and the wheel together.

The second motor may be connected to a first gear and may rotate the first gear, and the first motor and the wheel may be connected to a second gear, and the second gear may rotate while interlocking with the first gear.

A supporter may be mounted on the base, and the wheel cover may be mounted on the supporter.

An elastic member may be provided at the supporter, and the elastic member may alleviate a shock applied to the wheel cover when the wheel travels on an uneven floor.

A front sensor that detects whether there is an obstacle in front of a travelling direction may be provided at one side of the base.

The front sensor may include a pressurizing part that directs toward outer sides of the base, and if the pressurizing part is pressurized by the obstacle during travel, it may be detected that there is an obstacle in front of the travelling direction.

A fall prevention sensor that detects whether a floor on which the autonomous cleaning device travels continues, may be provided at the base.

If the fall prevention sensor is placed on a lower floor than the floor on which the autonomous cleaning device travels, the fall prevention sensor may descend and may pressurize a switch so as to detect whether the floor continues.

A hole may be formed in the base positioned at a lower part of the fall prevention sensor, and part of the fall prevention sensor may be exposed to outer sides of the base through the hole.

A pad part may be provided at a lower part of the base, and a replaceable pad may be mounted on the pad part.

An upper part of the base may be covered by a cover, and a bumper may be provided at outer sides of the base and outer sides of the cover.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1A:
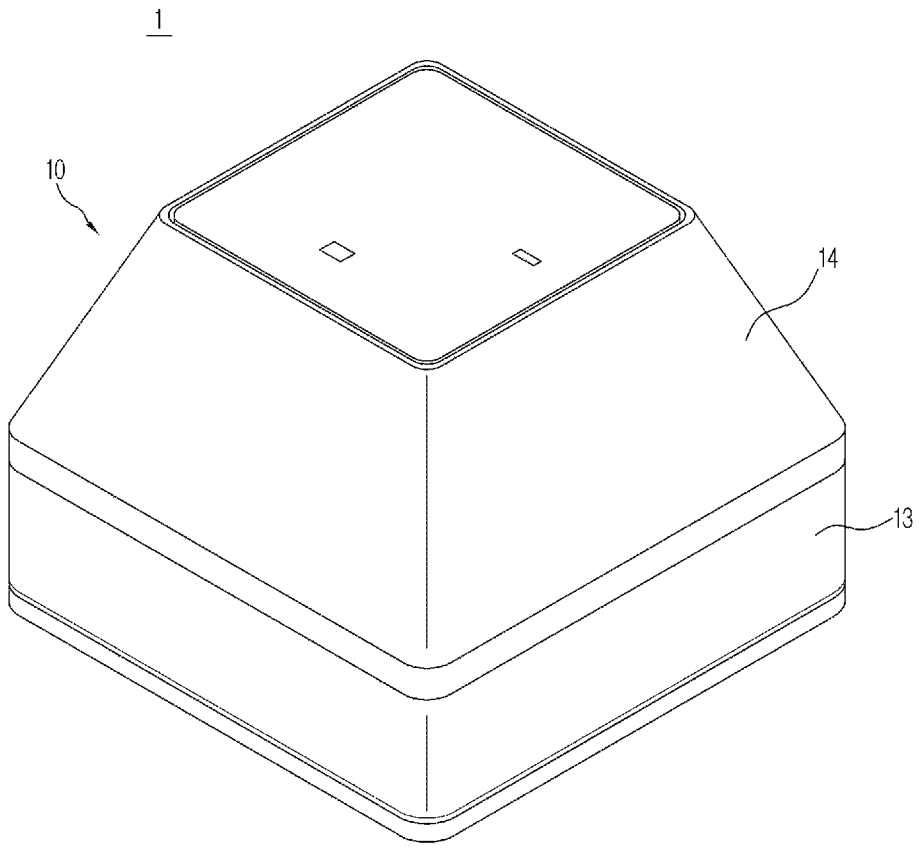
FIGS. 1A and 1B are perspective views illustrating an autonomous cleaning device according to an embodiment.

Reference will now be made in detail to the embodiments, examples of which are illustrated in the accompanying drawings, wherein like reference numerals refer to like elements throughout.

Figure 1B:
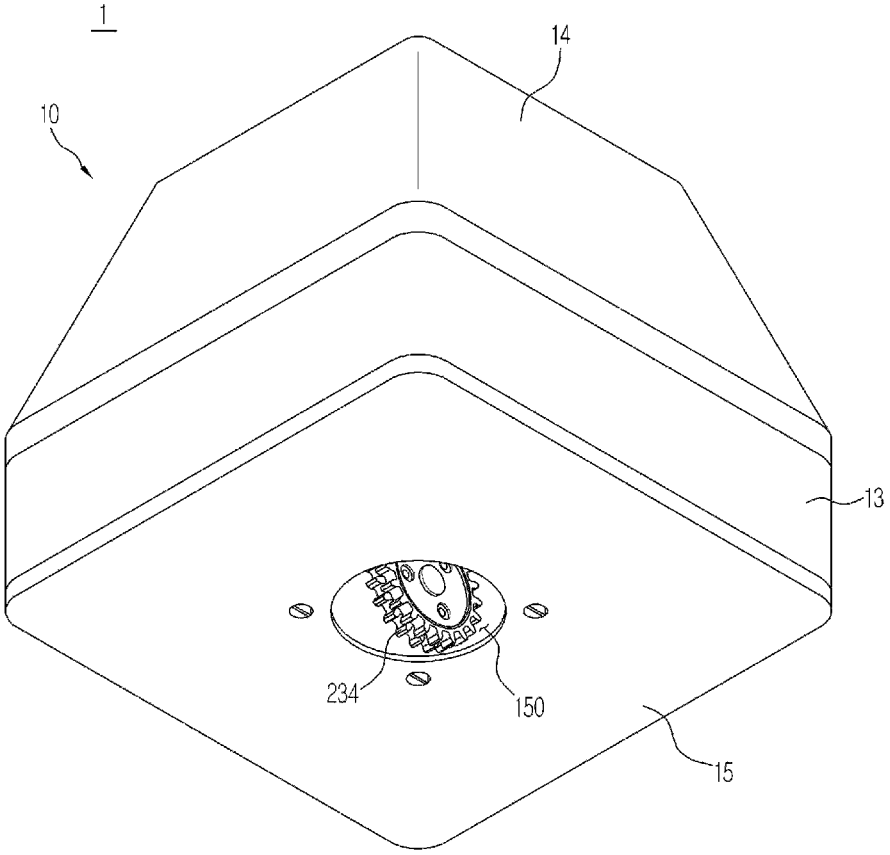
Figure 2:
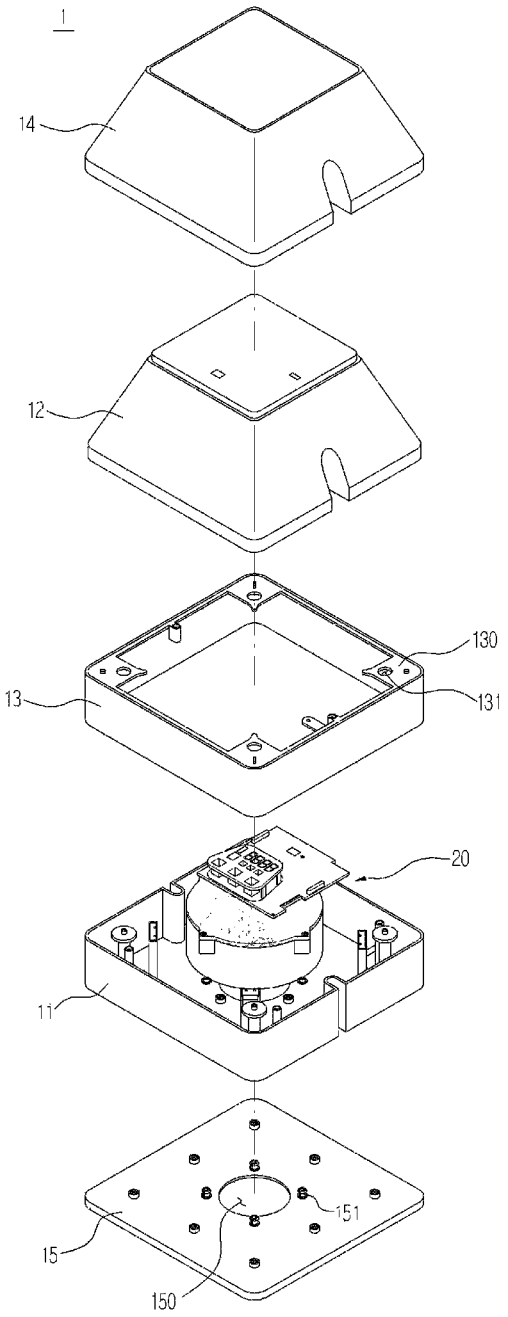
FIG. 2 is an exploded perspective view illustrating the autonomous cleaning device illustrated in FIG. 1.

FIGS. 1A and 1B are perspective views illustrating an autonomous cleaning device according to an embodiment, and FIG. 2 is an exploded perspective view illustrating the autonomous cleaning device illustrated in FIG. 1.

As illustrated in FIGS. 1A, 1B, and 2, an autonomous cleaning device 1 may include a housing 10 and a wheel unit 20. The housing 10 constitutes the exterior of the autonomous cleaning device 1 by encompassing the wheel unit 20. The wheel unit 20 is mounted in the housing 10 and is driven.

The housing 10 includes a case and a bumper. The case includes a base 11 and a cover 12. An upper part of the base 11 is open and is covered by the cover 12. The wheel unit 20 may be mounted in the base 11. The base 11 may be provided not only in a polygonal shape including a rectangular shape but also in a circular shape.

The bumper includes a bumper body 13 and a bumper cover 14. The bumper body 13 is provided at outer sides of the base 11, and the bumper cover 14 is provided at outer sides of the cover 12. The bumper may alleviate a shock applied to the autonomous cleaning device 1 when the autonomous cleaning device 1 collides with an obstacle during travel. The bumper body 13 may be provided at all outer sides of the base 11, and the bumper cover 14 may be provided at all outer sides of the cover 12. For example, when the base 11 is provided in a rectangular shape, the bumper body 13 may be provided at four sides of the base 11. The bumper cover 14 may also be provided at four sides of the cover 12.

A pad part 15 may be mounted on a bottom surface of the base 11. A top surface of the pad part 15 is mounted on the bottom surface of the base 11. A hole 150 through which a wheel may be exposed, may be provided in the center of the pad part 15. A fibered pad (not shown) that may clean a floor may be mounted on a bottom surface of the pad part 15. The pad (not shown) may be mounted on the bottom surface of the pad part 15 using a Velcro.

An elastic member 151 may be positioned on the top surface of the pad part 15. The elastic member 151 may be interposed between the top surface of the pad part 15 and the bottom surface of the base 11. The elastic member 151 transmits an elastic force to the pad part 15 and the base 11 so that the autonomous cleaning device 1 can be balanced. The pad part 15 is mounted on a bottom surface of the base 11 so as to be movable by the elastic member 151 such that the autonomous cleaning device 1 can be balanced.

Figure 3:
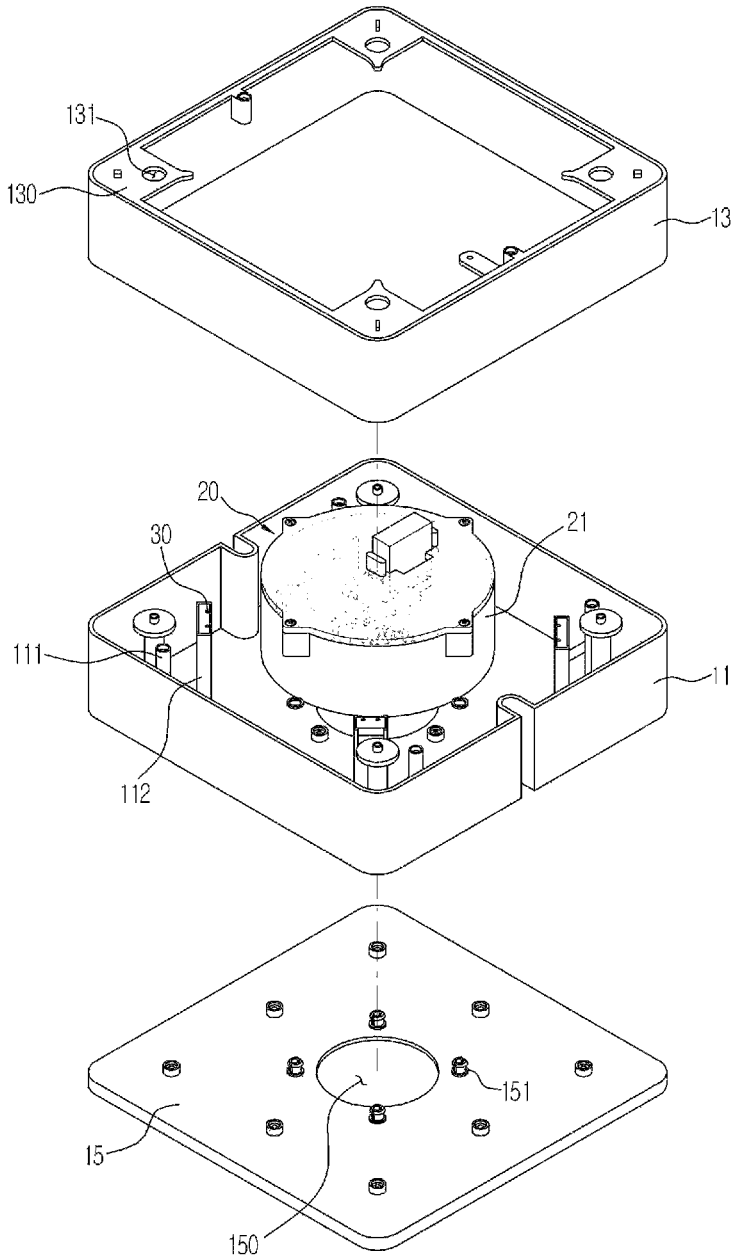
FIG. 3 is an exploded perspective view illustrating a main body of the autonomous cleaning device of FIG. 1.

FIG. 3 is part of an exploded perspective view of the autonomous cleaning device 1 of FIG. 1.

Referring to FIG. 3, the wheel unit 20 is mounted in the base 11. The bumper body 13 may be provided at outer sides of the base 11, and the pad part 15 may be mounted on the bottom surface of the base 11.

The bumper body 13 may be provided in a shape that corresponds to the outer sides of the base 11. The bumper body 13 may be provided to encompass the outer sides of the base 11. The bumper body 13 may be manufactured of a material that may absorb an external shock so as to alleviate a shock applied to the base 11 by an obstacle. An arm 130 that protrudes toward an inner side of the bumper body 13 may be formed at the bumper body 13. A plurality of arms 130 may be provided at edges of the bumper body 13. A coupling hole 131 may be formed in one side of each of the plurality of arms 130. A coupling rib 111 of the base 11 may be inserted into the coupling hole 131.

The wheel unit 20 is mounted on the bottom surface of the base 11. The wheel unit 20 may be positioned in the center of the bottom surface of the base 11. A hole is formed in the center of the base 11 so that the wheel 233 can be exposed to the outside. The coupling rib 111 that may be inserted into the coupling hole 131 may protrude from the bottom surface of the base 11. The coupling rib 111 may be allowed to penetrate the coupling hole 131 so that the bumper body 13 can be movably mounted on the base 11. In this case, a diameter of the coupling hole 131 is greater than a diameter of the coupling rib 111.

A sensor coupling part 112 on which a sensor 30 may be mounted may protrude from the bottom surface of the base 11. The sensor coupling part 112 may be provided in a position where an end of the arm 130 formed at the bumper body 13 may pressurize the sensor 30 mounted on the sensor coupling part 112 due to an external shock. When the shape of the bumper body 13 is modified by the obstacle, the arm 130 that protrudes toward the inner side of the bumper body 13 may pressurize the sensor 30, and when the sensor 30 is pressurized by the arm 130, the sensor 30 detects that there is an obstacle ahead and transmits detected information to a controller (not shown). The controller (not shown) may operate the autonomous cleaning device 1 so that the autonomous cleaning device 1 can be prevented from being caught by the obstacle.

A plurality of sensor coupling parts 112 and a plurality of sensors 30 may be provided so as to detect all obstacles positioned in an omni-direction of the autonomous cleaning device 1. For example, when the autonomous cleaning device 1 is provided in a rectangular shape from a top view, the sensor 30 and the sensor coupling part 112 may be provided at each edge of a rectangle. A plurality of arms 130 may be provided in positions corresponding to the sensor 30.

The pad part 15 may be mounted on the bottom surface of the base 11. The pad part 15 may be coupled to the bottom surface of the base 11 by a fastening member. The elastic member 151 may be interposed between the top surface of the pad part 15 and the bottom surface of the base 11. As such, even when the autonomous cleaning device 1 is driven by one wheel unit 20, the autonomous cleaning device 1 may be balanced by the elastic member 151.

Figure 4:
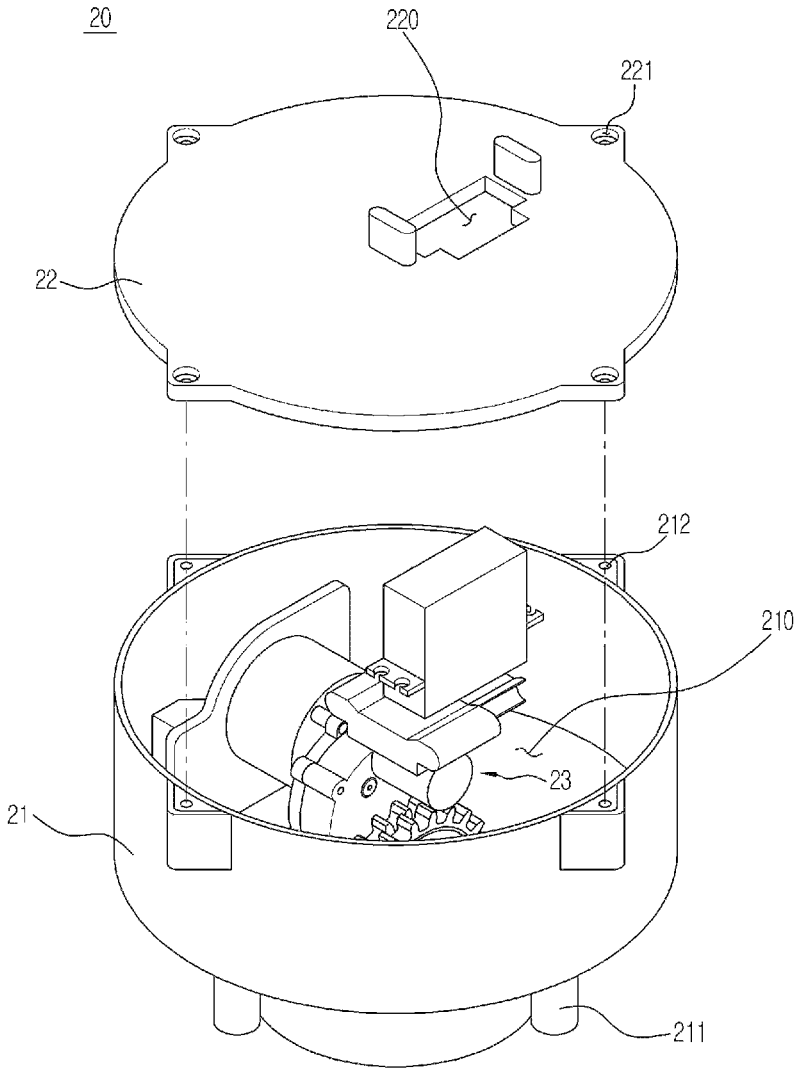
FIG. 4 is a view illustrating a wheel unit of the autonomous cleaning device of FIG. 1.
Figure 5:
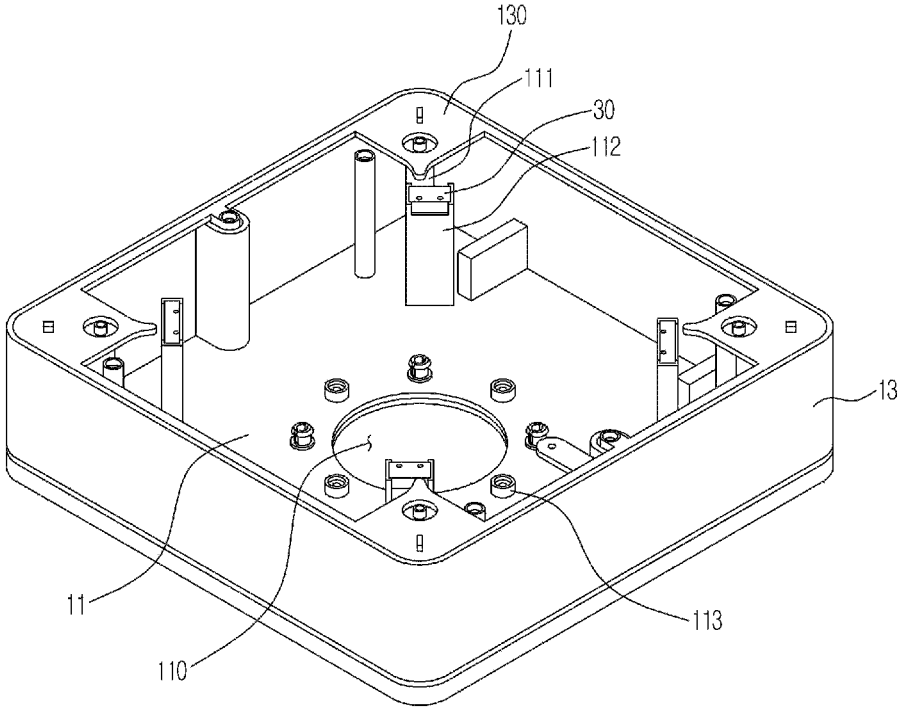
FIG. 5 is a view illustrating a case of the autonomous cleaning device of FIG. 1.
Figure 6:
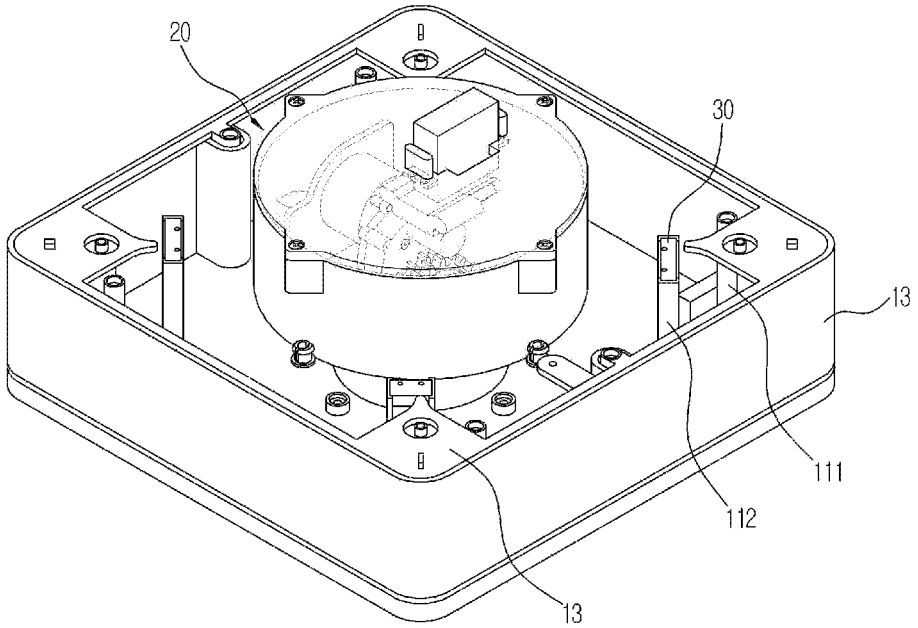
FIG. 6 is a view illustrating a state in which a cover of the autonomous cleaning device of FIG. 1 is removed.

FIG. 4 is a view illustrating the wheel unit 20 of the autonomous cleaning device 1 of FIG. 1, FIG. 5 is a view illustrating the case of the autonomous cleaning device 1 of FIG. 1, and FIG. 6 is a view illustrating a state in which the cover 12 of the autonomous cleaning device 1 of FIG. 1 is removed.

Referring to FIGS. 4 through 6, the wheel unit 20 includes a wheel case 21 having an accommodation part 210 formed therein, a wheel cover that covers an upper opening of the wheel case 21, and a wheel assembly 23 that is accommodated in the accommodation part 210. A hole (not shown) is formed in a bottom surface of the wheel case 21 so that the wheel 233 of the wheel assembly 23 can be exposed to the outside. The hole (not shown) formed in the wheel case 21, the hole 110 formed in the bottom surface of the base 11, and the hole 150 formed in the pad part 15 may communicate with one another.

A plurality of legs 211 may be provided by protruding from the bottom surface of the wheel case 21. Grooves 113 that correspond to the plurality of legs 211 may be formed in a top surface of the base 11. The legs 211 may be inserted in and fixed to the grooves 113. The wheel case 21 may be fastened to the top surface of the base 11. As such, the wheel unit 20 may be mounted in the base 11. A coupling hole 212 to be coupled to the wheel cover 22 may be formed in an upper side of the wheel case 21.

A hole 220 may be formed in the wheel cover 22 so that part of the wheel assembly 23 or a cable (not shown) connected to the wheel assembly 23 can be connected to a power supply unit, a circuit unit, and the like. A coupling hole 221 to be coupled to the wheel case 21 may be formed in the wheel cover 22. The wheel cover 22 may be mounted on the wheel case 21 using a fastening member that passes through the coupling hole 212 formed in the wheel case 21 and the coupling hole 221 formed in the wheel cover 22.

Figure 7:
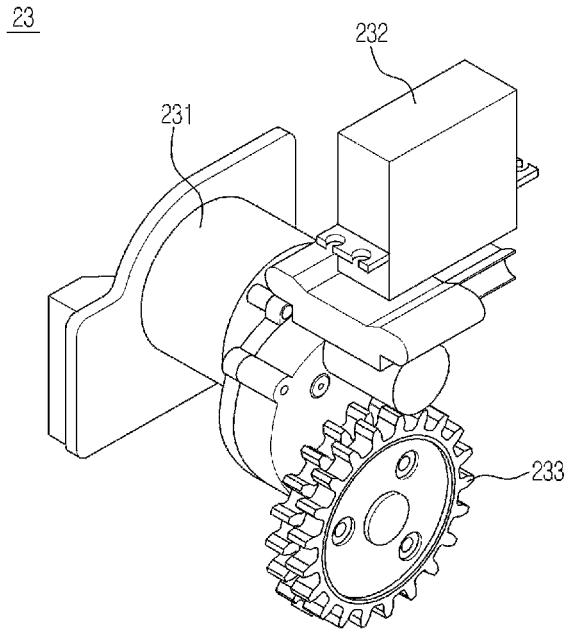
FIG. 7 is a view illustrating a wheel assembly according to an embodiment.
Figure 8:
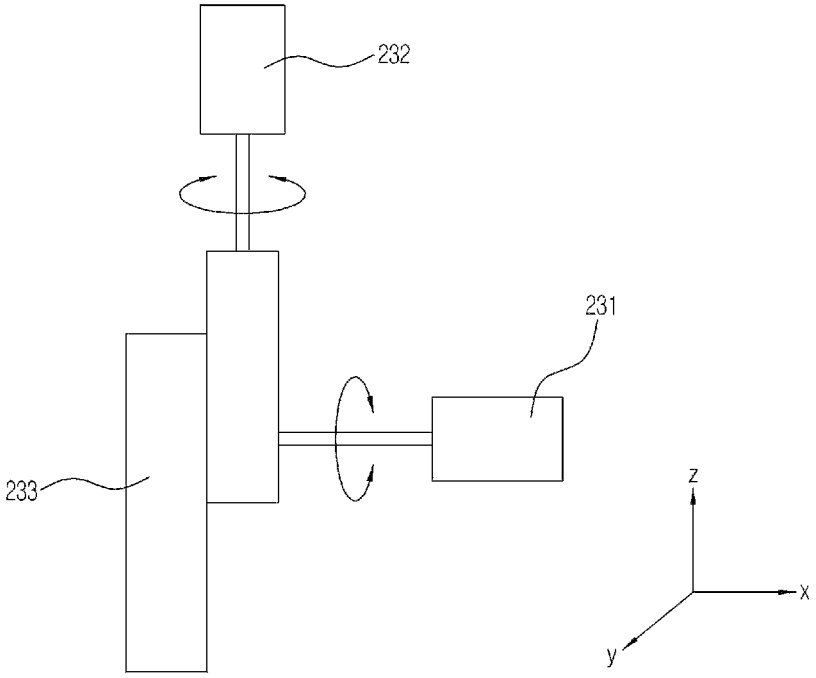
FIG. 8 is a conceptual view illustrating an operation of the wheel assembly illustrated in FIG. 7.

FIG. 7 is a view illustrating a wheel assembly according to an embodiment, and FIG. 8 is a conceptual view illustrating an operation of the wheel assembly illustrated in FIG. 7.

Referring to FIGS. 7 and 8, the wheel assembly 23 includes a first motor 231, a second motor 232, and a wheel 233. The wheel 233 may be exposed to an outside of the autonomous cleaning device 1 by passing through the hole (not shown) formed in the wheel case 21, the hole 110 formed in the bottom surface of the base 11, and the hole 150 formed in the pad part 15. The wheel 233 is in contact with the floor on which the autonomous cleaning device 1 is placed.

The wheel 233 may be rotated around an X-axis by the first motor 231 clockwise or counterclockwise. The wheel 233 is rotated by the first motor 231 so that the autonomous cleaning device 1 can travel. For example, when the wheel 233 is rotated clockwise, the autonomous cleaning device 1 may travel forward, and when the wheel 233 is rotated counterclockwise, the autonomous cleaning device 1 may travel backward.

The wheel 233 may be rotated around a Z-axis by the second motor 232 clockwise or counterclockwise. In this case, the wheel 233 and the first motor 231 may be rotated around the Z-axis by the second motor 232 clockwise or counterclockwise. When the wheel 233 is rotated by the second motor 232, a direction in which the autonomous cleaning device 1 travels may be changed. The travelling direction of the autonomous cleaning device 1 may be changed by an angle at which the wheel 233 is rotated.

For example, when the wheel 233 is rotated around the Z-axis by the second motor 232 at a predetermined angle clockwise, the wheel 233 may be disposed in such a way that the autonomous cleaning device 1 can move to the right of a forward direction or to the left of a backward direction. When, in a state in which the wheel 233 is rotated around the Z-axis at a predetermined angle, the wheel 233 is rotated around the X-axis by the first motor 231 clockwise, the autonomous cleaning device 1 may travel to the right of the forward direction, and when the wheel 233 is rotated around the X-axis by the first motor 231 counterclockwise in the above state, the autonomous cleaning device 1 may travel to the left of the backward direction. When the autonomous cleaning device 1 is rotated around the Z-axis at a predetermined angle counterclockwise, the wheel 233 may be disposed in such a way that the autonomous cleaning device 1 may move to the left of the forward direction or to the right of the backward direction. When, in a state in which the wheel 233 is rotated around the Z-axis at a predetermined angle, the wheel 233 is rotated around the X-axis by the first motor 231 clockwise, the autonomous cleaning device 1 may travel to the left of the forward direction, and when the wheel 233 is rotated around the X-axis by the first motor 231 counterclockwise in the above state, the autonomous cleaning device 1 may travel to the right of the backward direction.

The wheel 233 is rotated by the first motor 231 clockwise or counterclockwise so that the autonomous cleaning device 1 can travel forward or backward. When the autonomous cleaning device 1 collides with an obstacle during travel and thus a shock is applied to the bumper body 13, an end of the arm 130 formed on the bumper body 13 pressurizes the sensor 30. The sensor 30 notifies the controller (not shown) that the obstacle has been detected in the travelling direction of the autonomous cleaning device 1, and the controller (not shown) may change a direction in which the wheel 233 travels, by driving the second motor 232.

As described above, the wheel 233 is rotated by the second motor 232 so that the travelling direction of the autonomous cleaning device 1 can be changed. As such, the autonomous cleaning device 1 may change direction without rotating in place and thus may travel in a particular direction. Thus, the autonomous cleaning device 1 can be prevented from being caught by the obstacle due to the efficient operation. Since the angle of the wheel 233 is changed and the wheel 233 can travel in the omni-direction, a plurality of sensors 30 may be provided to detect the obstacle positioned in the omni-direction. A plurality of arms 130 may be provided to correspond to the plurality of sensors 30.

Figure 9:
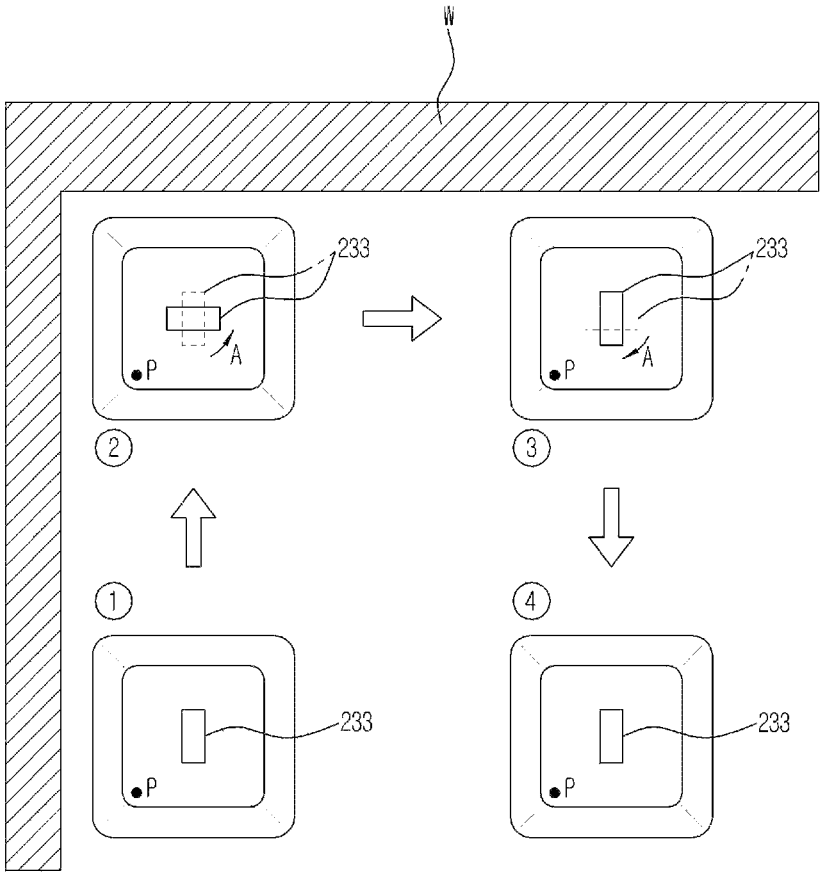
FIG. 9 is a view illustrating a state in which the autonomous cleaning device of FIG. 1 travels.

FIG. 9 is a view illustrating a state in which the autonomous cleaning device 1 of FIG. 1 travels.

Referring to FIG. 9, the travelling direction of the autonomous cleaning device 1 of FIG. 1 may be changed when the direction of the wheel 233 is changed. In detail, the travelling direction of the autonomous cleaning device 1 may be changed when the housing 10 of the autonomous cleaning device 1 is not rotated but the wheel 233 is rotated by the second motor 232.

For example, when the autonomous cleaning device 1 moves from position ① to position ② and it is detected by the sensor 30 that there is an obstacle W ahead, the wheel 233 is rotated by the second motor 232 at 90° in a direction A. After the wheel 233 is rotated at 90° in the direction A, the autonomous cleaning device 1 may move from position ② to position ③. In this case, the main body of the autonomous cleaning device 1 is not rotated but only the wheel 233 is rotated in the direction A and travels. Thus, the position of a point P located in an upper part of the bumper cover 14 of the autonomous cleaning device 1 is not changed in position ① and position ②.

When the autonomous cleaning device 1 travels from position ③ to position ④, as when travelling from position ② to position ③, the wheel 233 is rotated at 90° in the direction A and travels so that the autonomous cleaning device 1 can travel from position ③ to position ④. Even in this case, the position of the point P of the bumper cover 14 is not changed.

When the autonomous cleaning device 1 is provided in a polyhedral shape, if the autonomous cleaning device 1 needs to rotate so as to change direction like an autonomous cleaning device according to the related art, the autonomous cleaning device 1 requires a large rotation radius, and it takes a long time to rotate and travel. According to the present invention, the travelling direction of the wheel 233 is changed for a change of direction, and the main body of the autonomous cleaning device 1 does not need to rotate. Thus, a narrow crevice or a corner can be easily cleaned, and an unnecessary operation is reduced so that a cleaning time can be reduced.

Although the autonomous cleaning device 1 whereby the floor is cleaned by the pad part 15 provided on the bottom surface of the base 11 has been described as above, the above-described feature that the main body of the autonomous cleaning device 1 is not rotated but the travelling direction of the wheel 233 is changed so that the travelling direction of the autonomous cleaning device 1 can be changed, may also apply to an autonomous cleaning device that is capable of performing vacuum cleaning. In the autonomous cleaning device capable of vacuum cleaning, a caster is provided on a bottom surface of a base so that, even when the autonomous cleaning device travels by a single wheel, the autonomous cleaning device can be balanced and can travel.

Figure 10:
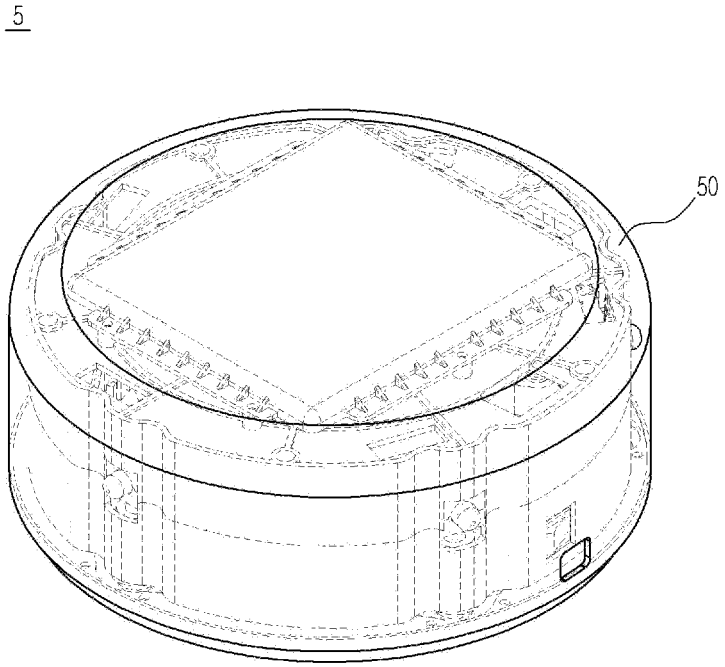
FIG. 10 is a perspective view illustrating an autonomous cleaning device according to another embodiment.
Figure 11:
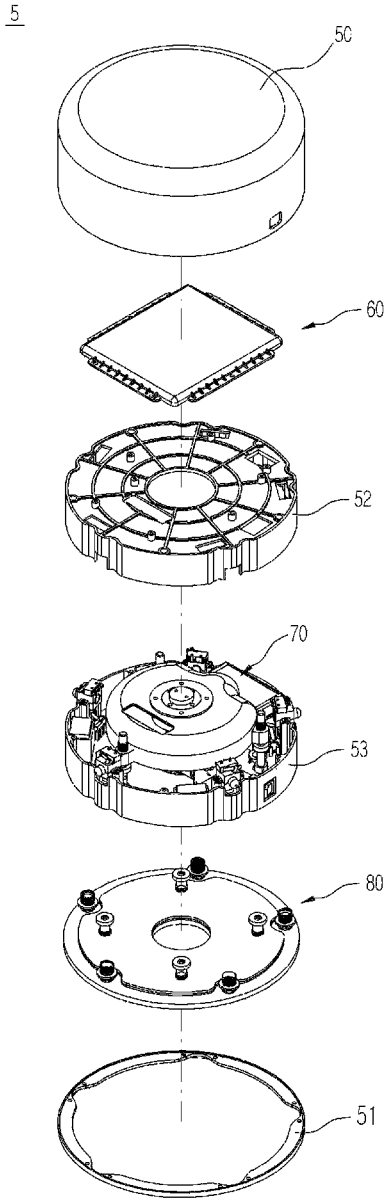
FIG. 11 is an exploded perspective view illustrating the autonomous cleaning device illustrated in FIG. 10.

FIG. 10 is a perspective view illustrating an autonomous cleaning device according to another embodiment, and FIG. 11 is an exploded perspective view illustrating the autonomous cleaning device illustrated in FIG. 10.

Referring to FIGS. 10 and 11, an autonomous cleaning device 5 according to another embodiment of the present invention includes a housing and a wheel unit 70. The wheel unit 70 may be mounted in the housing. A pad part 80 is mounted on a bottom surface of the housing. The autonomous cleaning device 5 according to another embodiment of the present invention may be provided in a circular shape. That is, the autonomous cleaning device 5 may be provided to have a circular shape when it is viewed from the above or from below.

The housing includes a cover 52 and a base 53. The cover 52 is mounted on an upper side of the base 53 and covers an upper part of the base 53. A wheel unit 70 may be mounted in the base 53. The pad part 80 may be mounted on a bottom surface of the base 53. A circuit unit 60 may be provided at an upper part of the cover 52 or in a space between the cover 52 and the base 53.

A bumper may be mounted on the housing. The bumper may alleviate a shock applied to the autonomous cleaning device 5 when the autonomous cleaning device 5 collides with an obstacle during travel. The bumper includes a bumper body 50 and a bumper cover 51. The bumper body 50 is mounted to encompass the cover 52 and outer sides of the base 53. In detail, the bumper body 50 may be provided to encompass outer sides t other than the bottom surface of the base 53. The bumper cover 51 may be provided in a ring shape corresponding to the shape of the outer sides of the base 53. The bumper cover 51 is coupled to the bottom surface of the bumper body 50. The bumper cover 51 and the bumper body 50 may be fastened to each other using a screw.

Figure 12:
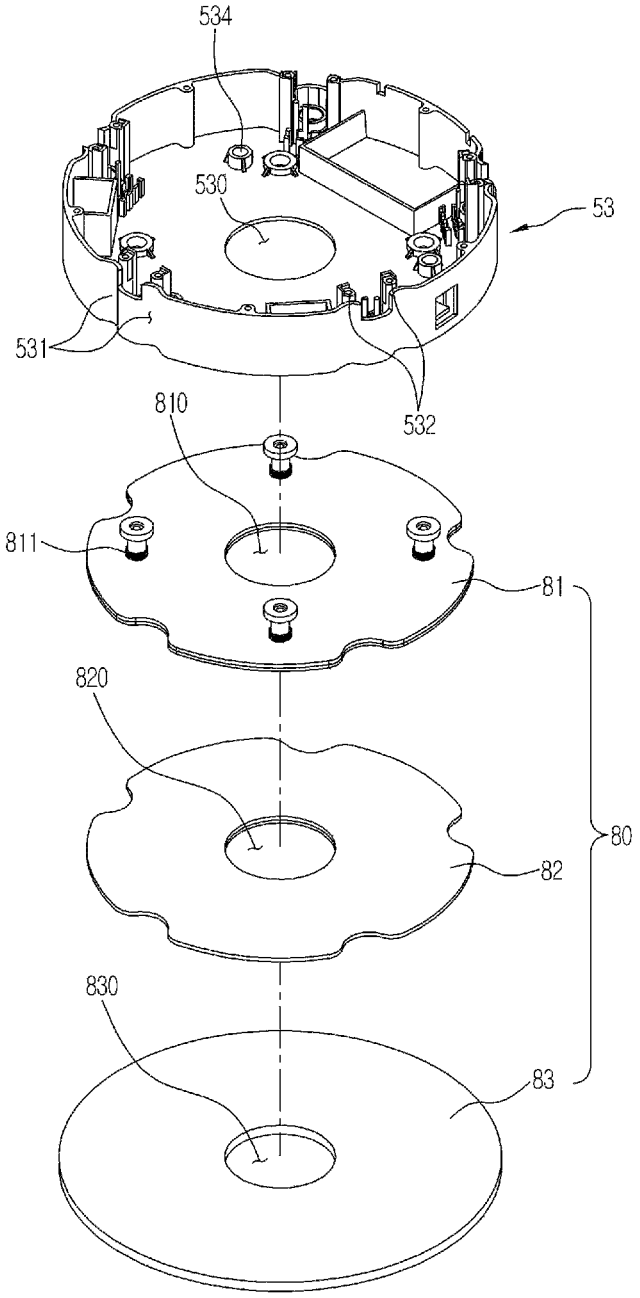
FIG. 12 is an exploded perspective view illustrating a base and a pad part of the autonomous cleaning device of FIG. 10.

FIG. 12 is an exploded perspective view illustrating the base 53 and the pad part 80 of the autonomous cleaning device 5 of FIG. 10.

Referring to FIG. 12, the pad part 80 is mounted on the bottom surface of the base 53 of the autonomous cleaning device 5 of FIG. 10. The pad part 80 may be coupled to the bottom surface of the base 53 using a fastening member. Holes 810, 820, and 830 through which a wheel 74 may pass may be formed in the pad part 80. An elastic member 811 may be interposed between a top surface of the pad part 80 and the bottom surface of the base 53. As such, even when the autonomous cleaning device 5 is driven by one wheel, the autonomous cleaning device 5 can be balanced by the elastic member 811.

The pad part 80 may include a panel part 81, a coupling part 82, and a pad 83. The panel part 81 may be coupled to the bottom surface of the base 53 using the fastening member. The elastic member 811 may be provided on a top surface of the panel part 81. The hole 810 through which the wheel 74 may pass is formed in the panel part 81.

The coupling part 82 may be coupled to a bottom surface of the panel part 81. For example, the coupling part 82 may be a Velcro. The coupling part 82 may be adhered to the bottom surface of the panel part 81 using an adhesive or an adhesive tape. The hole 820, which corresponds to the hole 810 formed in the panel part 81 and through which the wheel 74 may pass may be formed in the coupling part 82.

A pad 83 may be detachably mounted on a bottom surface of the coupling part 82. The pad 83 is in contact with the floor so as to clean the floor. The pad 83 is provided to be detached from the coupling part 82 and to be replaced with another one. The pad 83 may be detached from the coupling part 82, may be used after washing, and may be provided as a disposable pad. The hole 830, which corresponds to the holes 810 and 820 formed in the panel part 81 and the coupling part 82 and through which the wheel 74 may pass may be formed in the pad 83.

Grooves 531 may be formed in the outer sides of the base 53 and may be concave inward the base 53. The grooves 531 may be formed long in a vertical direction. Grooves 531 that correspond to the grooves 531 may be formed in inner sides of the bumper body 50. When the bumper body 50 is mounted on the outer sides of the base 53, the bumper body 50 may not slide along the outer sides of the base 53 but may be fixed due to the grooves 531 formed in the base 53 and the grooves 531 formed in the bumper body 50.

Ribs 532 on which a sensor may be mounted and grooves 534 in which a supporter 536 that constitutes a suspension part may be mounted, may be provided in an inner bottom surface of the base 53. Descriptions of the sensor and the suspension part will be provided below.

Figure 13:
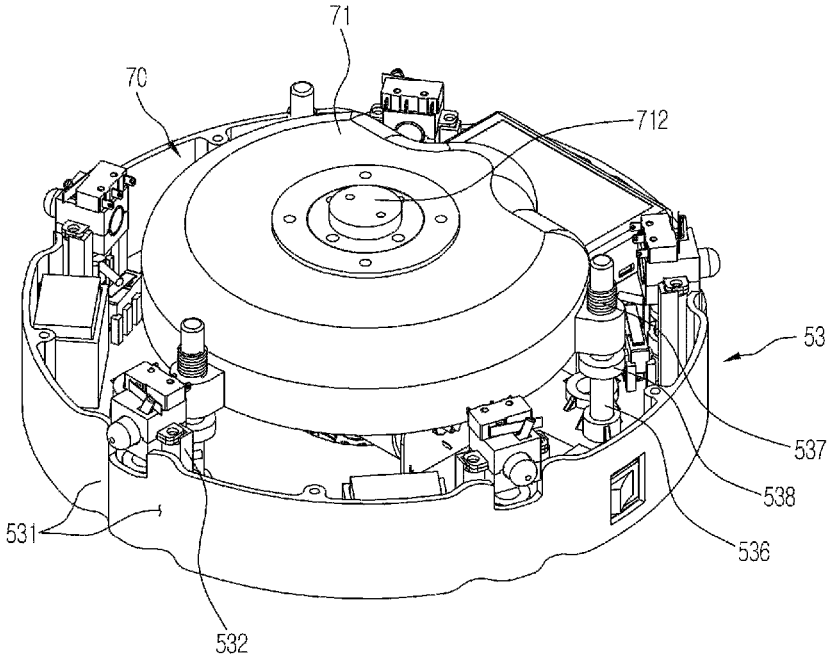
FIG. 13 is a view illustrating a main body of the autonomous cleaning device of FIG. 10.
Figure 14:
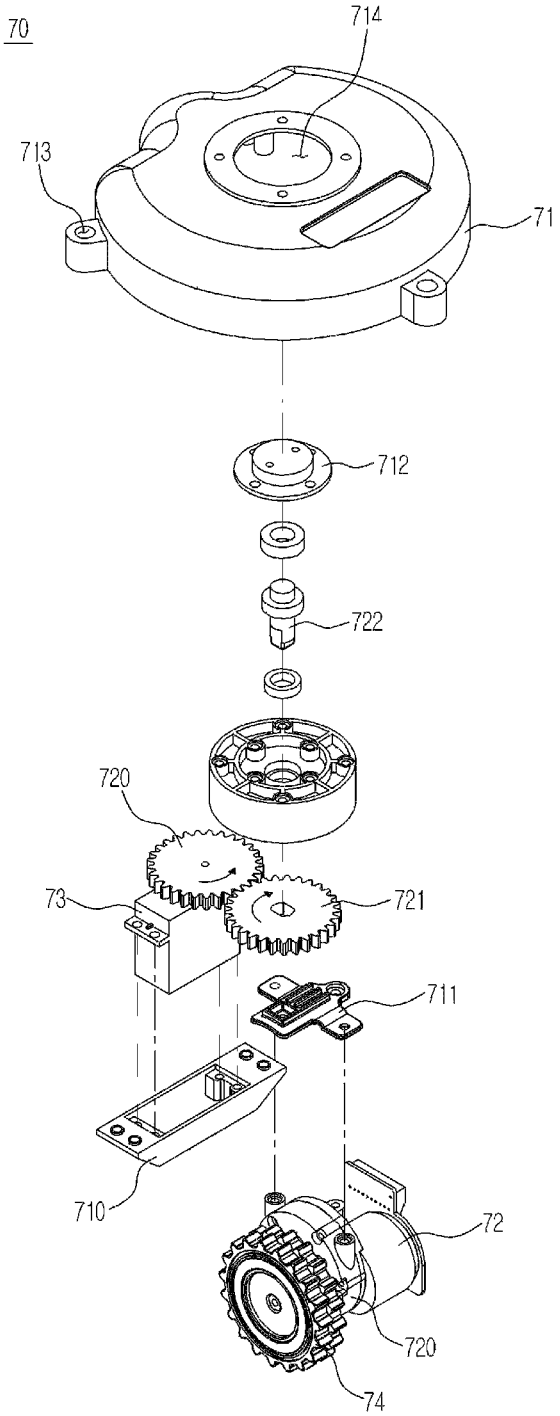
FIG. 14 is an exploded perspective view illustrating a wheel unit of the autonomous cleaning device of FIG. 10.
Figure 15:
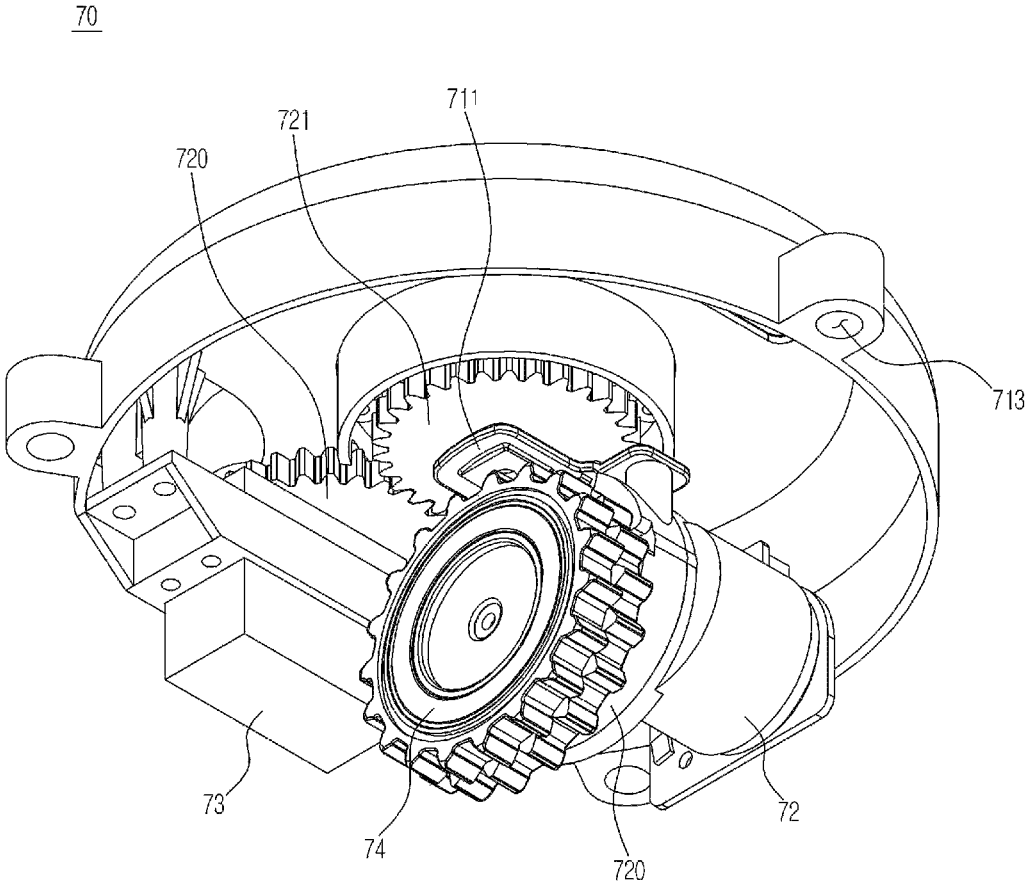
FIG. 15 is a view illustrating the wheel unit of the autonomous cleaning device of FIG. 10.

FIG. 13 is a view illustrating a main body of the autonomous cleaning device 5 of FIG. 10, FIG. 14 is an exploded perspective view illustrating a wheel unit of the autonomous cleaning device 5 of FIG. 10, and FIG. 15 is a view illustrating the wheel unit of the autonomous cleaning device 5 of FIG. 10.

Referring to FIGS. 13 through 15, a wheel unit 70 according to another embodiment of the present invention is mounted in the base 53. A hole 530 through which the wheel 74 may pass is formed in the bottom surface of the base 53. The wheel 74 passes through the hole 530, is in contact with the floor, and travels.

The wheel unit 70 includes a wheel cover 71, a first motor 72, a second motor 73, and a wheel 74. The first motor 72, the second motor 73, and the wheel 74 may be mounted on the wheel cover 71, and the wheel cover 71 may be mounted on the base 53.

A hole 713 into which the supporter 536 may be inserted may be formed in the wheel cover 71. One end of the supporter 536 may be inserted into the groove 534 formed in the base 53, and the other end of the supporter 536 may be inserted into the hole 713 formed in the wheel cover 71. A protruding hanging part 538 may be formed on an outer side of the supporter 536. The diameter of the hanging part 538 may be greater than the diameter of the groove 534. The groove 534 may not pass through the hanging part 538, and the wheel cover 71 may be supported by the hanging part 538. As such, the wheel cover 71 may be mounted on the base 53.

The wheel 74 may be coupled to a rotation axis of the first motor 72 so as to be rotated by the first motor 72. A first gear 720 may be interposed between the wheel 74 and the first motor 72. A gear that transmits torque of the first motor 72 to the wheel 74 may be provided in the first gear 720. A portion in which the wheel 74 and the first motor 72 are connected to each other may be referred to as a wheel assembly. A bracket 711 is mounted at one side of the first gear 720. A shaft 722 may be mounted on the bracket 711. In this case, the shaft 722 is fixed to and mounted on the bracket 711 so that the bracket 711 can rotate due to rotation of the shaft 722. As such, the wheel assembly can rotate due to rotation of the shaft 722.

The wheel 74 may be rotated around the X-axis by the first motor 72 clockwise or counterclockwise. The wheel 74 is rotated by the first motor 72 so that the autonomous cleaning device 5 can travel. For example, when the wheel 74 is rotated clockwise, the autonomous cleaning device 5 may travel forward, and when the wheel 74 is rotated counterclockwise, the autonomous cleaning device 5 may travel backward.

The second motor 73 may be mounted in a motor case 710. The motor case 710 may be mounted in an inner side of the wheel cover 71. As such, the second motor 73 may be mounted on the wheel cover 71. A rotation axis (not shown) of the second motor 73 is connected to the first gear 720. The first gear 720 may be rotated by the second motor 73. The first gear 720 is engaged with a second gear 721. As such, the second gear 721 may rotate while interlocking with the first gear 720.

The shaft 722 is mounted on the second gear 721. The shaft 722 is mounted on the second gear 721 so as to rotate together with the second gear 721. For example, a non-circular hole may be formed in the second gear 721, and an outer side of the shaft 722 may be provided in a shape corresponding to the hole and may be inserted into the hole. As such, the shaft 722 may rotate together with the second gear 721. A hole having a similar shape to the shape of the hole formed in the second gear 721 may be formed in the bracket 711 mounted on the first gear 720 and thus, the shaft 722 may pass through the hole.

The shaft 722 may be provided to pass through the hole formed in the second gear 721 and the hole formed in the bracket 711. Torque provided by the second motor 73 is transmitted to the first gear 720, and as the first gear 720 is rotated, the second gear 721 is rotated while interlocking with the first gear 720. As the second gear 721 is rotated, the shaft 722 mounted on the second gear 721 is rotated, and as the shaft 722 is rotated, the wheel assembly that is coupled to the bracket 711 at which the shaft 722 is fixedly installed, may be rotated. A cap 712 may be provided at an upper end of the shaft 722. The cap 712 may be mounted on the wheel cover 71.

The wheel 74 may be rotated around the Z-axis by the second motor 73 clockwise or counterclockwise. In this case, the wheel 74 and the first motor 72 may be rotated around the Z-axis by the second motor 73 clockwise or counterclockwise. When the wheel 74 is rotated by the second motor 73, a direction in which the autonomous cleaning device 5 travels may be changed. The travelling direction of the autonomous cleaning device 5 may be changed by an angle at which the wheel 74 is rotated.

Figure 16:
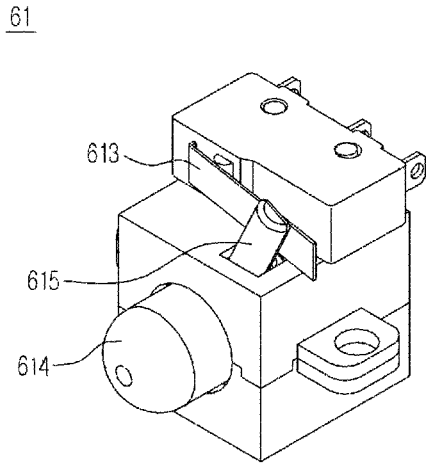
FIG. 16 is a view illustrating a front sensor of the autonomous cleaning device of FIG. 10.
Figure 17:
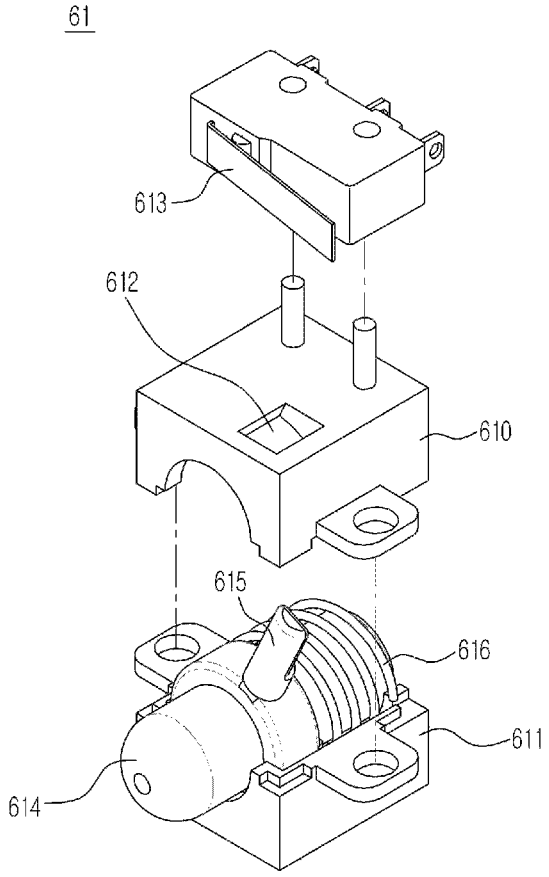
FIG. 17 is an exploded perspective view illustrating the front sensor of the autonomous cleaning device of FIG. 10.
Figure 18:
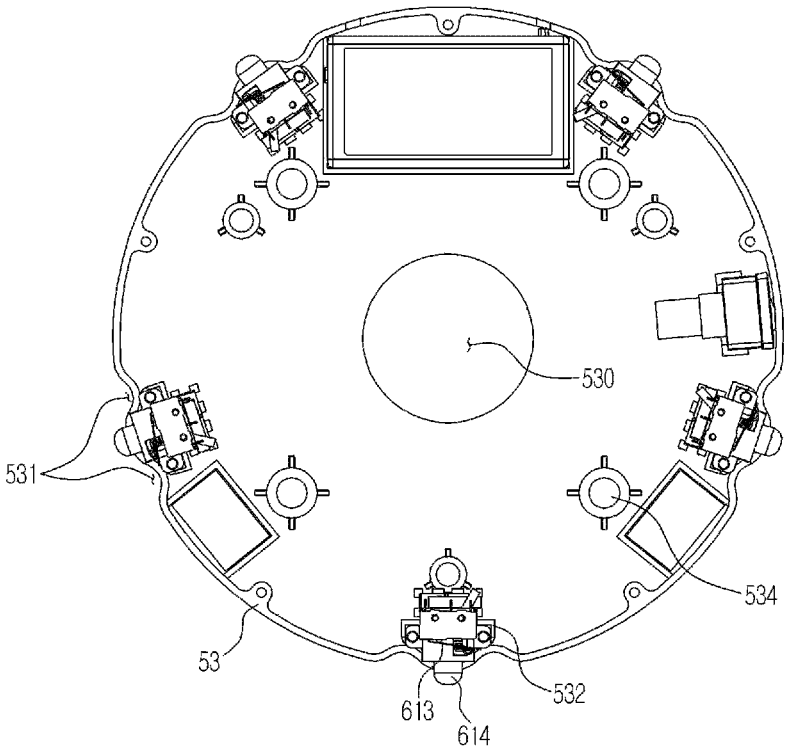
FIG. 18 is a view illustrating a state in which the main body of the autonomous cleaning device of FIG. 10 is viewed from the above.

FIG. 16 is a view illustrating a front sensor of the autonomous cleaning device 5 of FIG. 10, FIG. 17 is an exploded perspective view illustrating the front sensor of the autonomous cleaning device 5 of FIG. 10, and FIG. 18 is a view illustrating a state in which the main body of the autonomous cleaning device 5 of FIG. 10 is viewed from the above.

Referring to FIG. 13 and FIGS. 16 through 18, a front sensor 61 according to an embodiment may be mounted on the ribs 532 formed in the base 53. The front sensor 61 may detect whether there is an obstacle in front of the travelling direction of the autonomous cleaning device 5. When the autonomous cleaning device 5 collides with the obstacle during travel, the front sensor 61 is pressurized and transmits information that there is the obstacle in front of the autonomous cleaning device 5 to a controller (not shown). A plurality of front sensors 61 may be provided along the circumference of the base 53. As such, even when the travelling direction of the autonomous cleaning device 5 is changed, the front sensor 61 may detect whether there is the obstacle ahead.

The front sensor 61 includes housings 610 and 611, a switch 613, a pressurizing part 614, and an elastic member 616. The front sensor 61 may be coupled to the ribs 532 using a fastening member that passes through the housings 610 and 611. The housings 610 and 611 include an upper housing 610 and a lower housing 611. The pressurizing part 614 is mounted on the lower housing 611. A latch 615 may extend from one side of the pressurizing part 614. A hole 612 may be formed in one side of the upper housing 610. The latch 615 may pass through the hole 612 formed in the upper housing 610 and may be exposed to an outside of the upper housing 610. A switch 613 may be provided outside one side of the upper housing 610. The latch 615 is provided to pressurize the switch 613.

One end of the pressurizing part 614 may be provided to direct toward the outer sides of the base 53. The elastic member 616 may be provided at the other end of the pressurizing part 614. The elastic member 616 transmits an elastic force that is used to push the pressurizing part 614 toward the outer sides of the base 53, to the pressurizing part 614. When the obstacle pressurizing the pressurizing part 614 is removed, the pressurizing part 614 may be returned to its original position before it is pressurized, due to the elastic member 616.

When the autonomous cleaning device 5 collides with the obstacle, the pressurizing part 614 is pressurized. When the pressurizing part 614 is pressurized, the switch 613 is pressurized by the latch 615. As such, it may be detected that there is an obstacle outside the autonomous cleaning device 5. Information that there is an obstacle outside the autonomous cleaning device 5 may be transmitted to the controller (not shown). In order to avoid the obstacle, the controller (not shown) may drive the second motor 73 and may change the direction of the wheel 74 so as to change the travelling direction of the autonomous cleaning device 5. When the travelling direction of the autonomous cleaning device 5 is changed and the obstacle pressurizing the pressurizing part 614 is removed, the pressurizing part 614 is returned to its original position before it is pressurized. When the pressurizing part 614 is returned to its original position before it is pressurized, the latch 615 does not pressurize the switch 613 any longer. When the switch 613 is not pressurized, the controller (not shown) may determine that no obstacle is detected by the front sensor 61.

Figure 19:
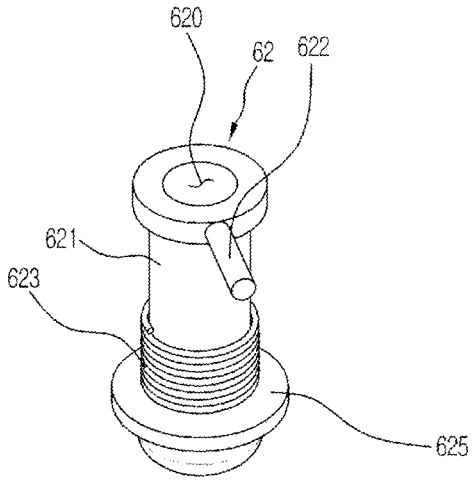
FIGS. 19 and 20 are views illustrating a fall prevention sensor of the autonomous cleaning device of FIG. 10.
Figure 20:
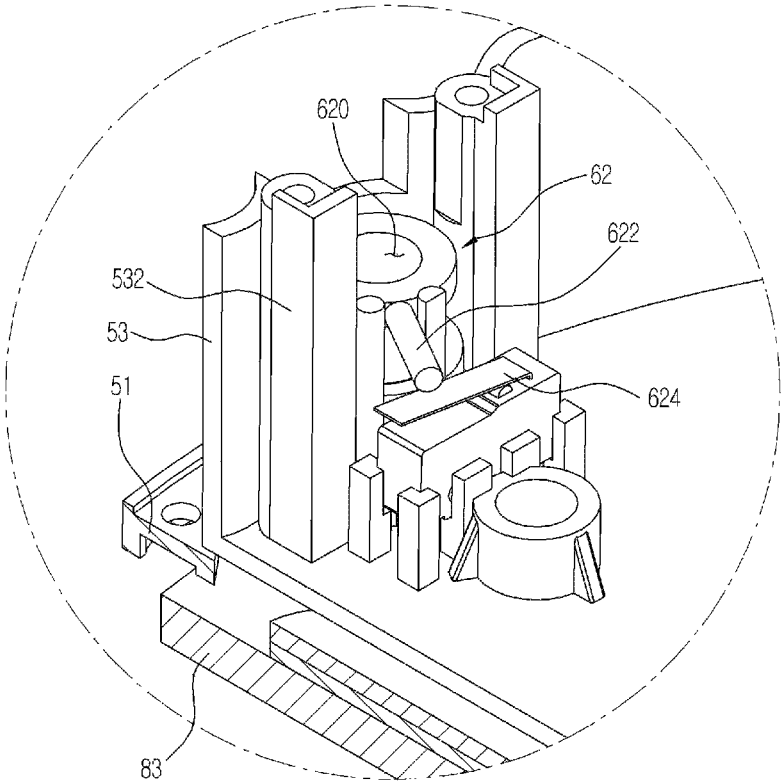

FIGS. 19 and 20 are views illustrating a fall prevention sensor of the autonomous cleaning device 5 of FIG. 10.

Referring to FIGS. 19 and 20, a fall prevention sensor 62 may be installed at the base 53 of the autonomous cleaning device 5 of FIG. 10. The fall prevention sensor 62 may be installed at the ribs 532 provided on the base 53. The front sensor 61 may be installed at upper sides of the ribs 532, and the fall prevention sensor 62 may be installed at lower sides of the ribs 532. A hole (not shown) may be formed in the bottom surface of the base 53 on which the ribs 532 are formed, and part of the fall prevention sensor 62 may be exposed to the outside of the base 53 through the hole (not shown).

The fall prevention sensor 62 may detect whether the floor on which the autonomous cleaning device 5 travels, continues. If it is detected by the fall prevention sensor 62 that a lower floor than the floor on which the autonomous cleaning device 5 travels is detected, the fall prevention sensor 62 transmits information that the lower floor than the floor on which the autonomous cleaning device 5 travels is detected in front of the autonomous cleaning device 5, to the controller (not shown). If the controller (not shown) receives the information, the controller (not shown) may change the direction of the wheel 74 so as to change the travelling direction of the autonomous cleaning device 5. As such, the autonomous cleaning device 5 can be prevented from falling.

The fall prevention sensor 62 includes a body 621, an elastic member 623, and a switch 624. The body 621 may be mounted on the ribs 532 formed on the base 53. Part of the body 621 may be exposed to the outside of the base 53 through the hole (not shown) formed in the bottom surface of the base 53 on which the ribs 532 are formed. A rib 625 may protrude from an outer side of the body 621. The body 621 may be interfered by the rib 625 and may be prevented from escaping from the hole (not shown). When the elastic member 623 is a spring, the elastic member 623 may be inserted in the body 621 positioned at the upper part of the rib 625.

Part of the body 621 exposed to the outside of the base 53 may contact a top surface of the pad 83. An accommodation part 620 in which a mass (not shown) may be accommodated, may be formed in the body 621. When the autonomous cleaning device 5 travels, a force is applied to the body 621 so as to pressurize the floor or the top surface of the pad 83 due to the mass. The elastic member 623 may be mounted on an outer side of the body 621 and may transmit an elastic force to the body 621. Due to the elastic member 623, an upward elastic force is applied to the body 621. A latch 622 may extend from one side of the body 621.

When the autonomous cleaning device 5 travels on the floor, the body 621 may pressurize the floor or the pad 83. In this case, the body 621 is lifted by the floor such that the latch 622 does not pressurize the switch 624.

When a lower floor than the floor on which the autonomous cleaning device 5 travels is detected and the floor positioned at the lower part of the body 621 is lower than the floor on which the autonomous cleaning device 5 travels, the body 621 may descend toward the lower floor. When the body 621 descends, the latch 622 pressurizes the switch 624. If the switch 624 is pressurized, the controller (not shown) determines that there is a lower floor than the floor on which the autonomous cleaning device 5 travels, near the autonomous cleaning device 5. If it is determined that there is a lower floor than the floor on which the autonomous cleaning device 5 travels, near the autonomous cleaning device 5, the controller (not shown) may drive the second motor 73 and may change the direction of the wheel 74 so as to change the travelling direction of the autonomous cleaning device 5. As such, the autonomous cleaning device 5 can be prevented from falling. Even when the body 621 descends toward the floor, the body 621 is interfered by the rib 625 and does not escape from the hole (not shown).

When the autonomous cleaning device 5 changes the travelling direction and is positioned on a floor on which the whole of the autonomous cleaning device 5 travels, the body 621 may be lifted by the floor on which the whole of the autonomous cleaning device 5 travels. If the body 621 is lifted, the latch 622 does not pressurize the switch 624 any longer. If the latch 622 does not pressurize the switch 624, the controller (not shown) may determine that there is no risk that the autonomous cleaning device 5 may fall and may control the autonomous cleaning device 5 to continuously perform an operation. As such, the autonomous cleaning device 5 can be prevented from falling.

Figure 21:
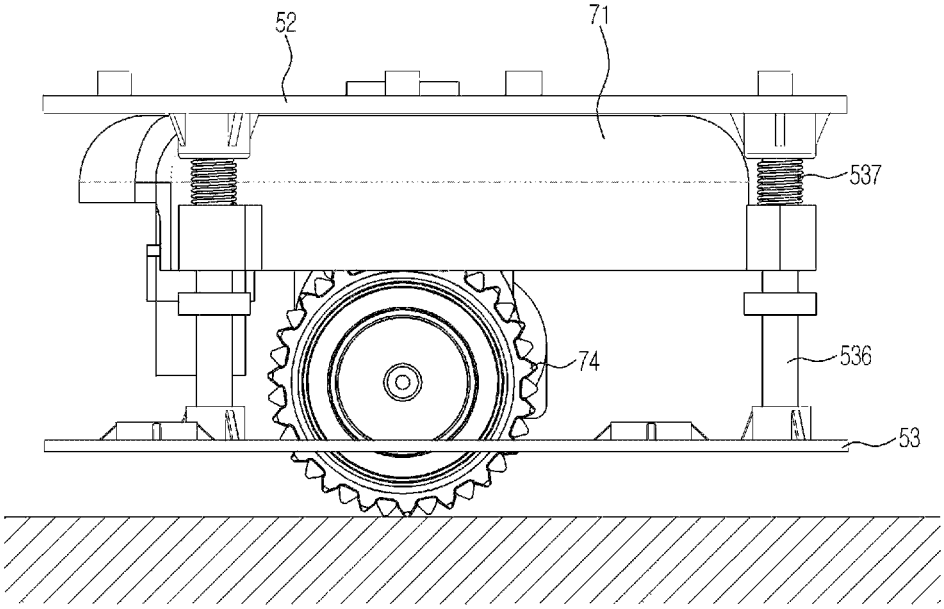
FIGS. 21 and 22 are views illustrating a suspension part of the autonomous cleaning device of FIG. 10.
Figure 22:
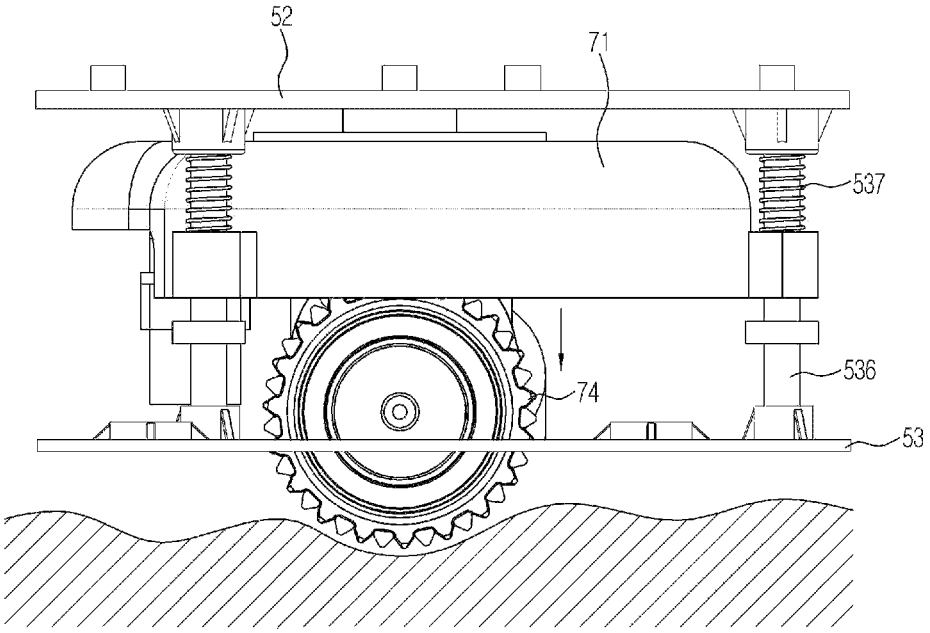

FIGS. 21 and 22 are views illustrating the suspension part of the autonomous cleaning device 5 of FIG. 10.

Referring to FIGS. 21 and 22, when travelling an uneven floor, the autonomous cleaning device 5 of FIG. 10 includes the suspension part that allows the wheel 74 to be closely adhered to the floor and to travel.

The suspension part includes the supporter 536 and an elastic member 537. The grooves 534 may be formed in the inner bottom surface of the base 53, and one end of the supporter 536 may be inserted in and mounted on the grooves 534. The protruding ribs 532 may be formed on an outer side of the supporter 536. The wheel cover 71 may be mounted on the supporter 536, and the cover 52 may be mounted on the upper part of the wheel cover 71. The wheel cover 71 may be mounted on upper sides of the ribs 532. The other end of the supporter 536 may be mounted on a bottom surface of the cover 52. The elastic member 537 is mounted on the supporter 536, is positioned between the wheel cover 71 and the cover 52, and applies an elastic force that is used to push the wheel cover 71 toward the floor, to the wheel cover 71. Thus, the wheel 74 mounted on the wheel cover 71 may be closely adhered to the floor.

Even when the autonomous cleaning device 5 travels an uneven floor, the wheel 74 may be closely adhered to uneven portions of the floor and may move. Also, the autonomous cleaning device 5 travels the uneven floor so that a shock that may be applied to the autonomous cleaning device 5 can be absorbed by the suspension part. As such, the autonomous cleaning device 5 can travel more stably.

As described above, in an autonomous cleaning device according to an embodiment, various travelling motions can be embodied, and the autonomous cleaning device can be efficiently prevented from being caught by an obstacle during travel. Also, even when one wheel is provided, the autonomous cleaning device can travel stably. Also, when being prevented from being caught by an obstacle, a main body of the autonomous cleaning device can change a travelling direction without rotating so that the autonomous cleaning device can be manufactured to have various designs in addition to an existing circular design.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An autonomous cleaning device comprising:

a case in which an accommodation part and a hole are formed;

a wheel assembly accommodated in the accommodation part, the wheel assembly comprising:

a wheel, of which part is exposed to an outside through the hole, a first motor that drives the wheel to, while the autonomous cleaning device is disposed on a first floor, cause the autonomous cleaning device to travel along the first floor, and a second motor that rotates the wheel so as to change a travelling direction of the autonomous cleaning device; and a fall prevention sensor comprising:

a switch, and a movable body having a latch extending from the movable body, wherein the movable body is positioned with respect to the switch, and a downward force is applied to the movable body, so that, when the autonomous cleaning device travels along the first floor, with a pad contacting the first floor and the movable body pressurizing the pad, to a second floor lower than the first floor so that the movable body is above the second floor, the movable body descends downward toward the second floor to cause the latch to contact the switch, which thereby causes the second motor to be driven to rotate the wheel to change the travelling direction, and when the traveling direction is changed so that the movable body is above the first floor, the movable body is lifted by the first floor so that the latch no longer contacts the switch.

2. The autonomous cleaning device according to claim 1, further comprising:

an elastic member interposed between a bottom surface of the case and a top surface of a pad part.

3. The autonomous cleaning device according to claim 1, further comprising:

a bumper at outer sides of the case, wherein the bumper covers all outer sides of the case.

4. The autonomous cleaning device according to claim 3, further comprising:

a sensor coupling part provided at the case, and a sensor, capable of detecting an external obstacle, mounted on the sensor coupling part.

5. The autonomous cleaning device according to claim 4, further comprising:

a plurality of inwardly-protruding arms at the bumper and configured so that, when the bumper is pressurized by an external shock, the plurality of arms to pressurize the sensor.

6. The autonomous cleaning device according to claim 5, further comprising:

a protruding coupling rib on a bottom of the case, wherein a coupling hole is formed in each of the arms, and the coupling rib is inserted into the coupling hole so that a bumper body is movably mounted on the case.

7. The autonomous cleaning device according to claim 3, further comprising:

a plurality of sensor coupling parts provided at the case; and a plurality of sensors mounted on the plurality of sensor coupling parts, respectively, to detect obstacles positioned in an omni-direction.

8. The autonomous cleaning device according to claim 1, wherein the pad is a replaceable pad, and the autonomous cleaning device further comprises:

a pad part to which the pad is attachable and detachable.

9. The autonomous cleaning device according to claim 1, further comprising:

a wheel case accommodating the wheel assembly and having a hole formed in a bottom of the wheel case through which the wheel passes.

10. The autonomous cleaning device according to claim 9, wherein the pad is a replaceable pad, the autonomous cleaning device further comprises a pad part to which the pad is attachable and detachable, and having a hole formed therein, and the hole formed in the bottom of the wheel case, the hole formed in the case, and the hole formed in a pad part communicate with one another so that the wheel passes through each of the holes to contact the first floor when the autonomous cleaning device is disposed on the first floor.

11. The autonomous cleaning device according to claim 9, further comprising:

legs are formed on a bottom surface of the wheel case, and grooves corresponding to the legs formed in a top surface of the case so that the legs are inserted into the grooves and the wheel case is fixed to the top surface of the case.

12. The autonomous cleaning device according to claim 1, further comprising:

a pad part, wherein the wheel is exposed to an outside through a center of the pad part.

13. The autonomous cleaning device according to claim 1, further comprising:

a mass applying the downward force to the movable body as the autonomous cleaning device travels along the first floor so that the movable body pressurizes the pad.

14. An autonomous cleaning device comprising:

a base having a first hole formed in a center of the base;

a pad part, which is mounted on a bottom surface of the base and in which a second hole corresponding to the first hole is formed;

a wheel that is accommodated in the base and is exposed to an outside through the first hole formed in the base and the second hole formed in the pad part;

a first motor that drives the wheel to, while the autonomous cleaning device is disposed on a first floor, cause the autonomous cleaning device to travel along the first floor;

a second motor that controls the wheel to change a travelling direction of the autonomous cleaning device; and a fall prevention sensor comprising:

a switch, and a movable body partially extending through the base and having a latch extending from the movable body, wherein the movable body is positioned with respect to the switch, and a downward force is applied to the movable body, so that, when the autonomous cleaning device travels along the first floor, with a pad coupled to the pad part contacting the first floor and the movable body pressurizing the pad, to a second floor lower than the first floor so that the movable body is above the second floor, the movable body descends downward toward the second floor to cause the latch to contact the switch, which thereby causes the second motor to be driven to control the wheel to change the travelling direction, and when the traveling direction is changed so that the movable body is above the first floor, the movable body is lifted by the first floor so that the latch no longer contacts the switch.

15. The autonomous cleaning device according to claim 14, further comprising:

a wheel cover mounted on the base, wherein the first motor and the second motor are mounted on the wheel cover.

16. The autonomous cleaning device according to claim 15, wherein the first motor is connected to the wheel, and the second motor rotates the first motor and the wheel together to thereby control the wheel.

17. The autonomous cleaning device according to claim 16, further comprising:

first and second gears, wherein the second motor is connected to the first gear and rotates the first gear, the first motor and the wheel are connected to the second gear, and the second gear rotates while interlocking with the first gear.

18. The autonomous cleaning device according to claim 15, further comprising:

a supporter mounted on the base, wherein the wheel cover is mounted on the supporter.

19. The autonomous cleaning device according to claim 18, further comprising:

an elastic member provided at the supporter, wherein the elastic member alleviates a shock applied to the wheel cover when the wheel travels on an uneven floor.

20. The autonomous cleaning device according to claim 14, further comprising:

a front sensor, provided at one side of the base, that detects whether there is an obstacle in front of the travelling direction.

21. The autonomous cleaning device according to claim 20, wherein the front sensor comprises a pressurizing part that directs toward outer sides of the base, and when the pressurizing part is pressurized by the obstacle during travel, the front sensor detects that there is an obstacle in front of the travelling direction.

22. The autonomous cleaning device according to claim 14, wherein the movable body of the fail prevention sensor passes through a hole in the base to thereby partially extend through the base and be exposed to an outside of the base.

23. The autonomous cleaning device according to claim 14, further comprising the pad, wherein the pad is a replaceable pad.

24. The autonomous cleaning device according to claim 14, further comprising:

a cover that covers an upper part of the base, and a bumper at outer sides of the base and outer sides of the cover.

25. An autonomous cleaning device comprising:

a base;

a case in which an accommodation part and a hole are formed;

a wheel assembly accommodated in the accommodation part, the wheel assembly comprising:

a single wheel, of which part is exposed to an outside of the case through the hole, a first motor that drives the wheel to, while the autonomous cleaning device is disposed on a first floor, cause the autonomous cleaning device to travel along the first floor, and a second motor that rotates the wheel to thereby cause a travelling direction of the autonomous cleaning device to be changed while maintaining the orientation of the autonomous cleaning device; and a fall prevention sensor comprising:

a switch, and a movable body having a latch extending from the movable body, wherein the movable body is positioned with respect to the switch, and a downward force is applied to the movable body, so that, when the autonomous cleaning device travels along the first floor, with a pad contacting the first floor and the movable body pressurizing the pad, to a second floor lower than the first floor so that the movable body is above the second floor, the movable body descends downward toward the second floor to cause the latch to contact the switch, which thereby causes the second motor to rotate the wheel to change the travelling direction, and when the traveling direction is changed so that the movable body is above the first floor, the movable body is lifted by the first floor so that the latch no longer contacts the switch.

* * * * *